United States Patent [19]

Ostroski et al.

[11] 4,360,970

[45] Nov. 30, 1982

[54] DEVICE FOR OPENING SEALED FOOD BAGS

[75] Inventors: Richard J. Ostroski, Jackson County, Mo.; James B. Aberer, Contra Costa Coumty, Calif.; Gary Best, Jackson County, Mo.

[73] Assignee: Rival Manufacturing Company, Kansas City, Mo.

[21] Appl. No.: 154,784

[22] Filed: May 30, 1980

[51] Int. Cl.[3] ..... B67B 7/00

[52] U.S. Cl. ..... 30/2; 30/294; 30/316; 30/DIG. 3; 83/912

[58] Field of Search ..... 30/2, 292, 294, 314, 30/316, 319, 358, 363, 365, 366, 408, DIG. 3; 83/886, 912; 81/9.5 B, 43

[56] References Cited

U.S. PATENT DOCUMENTS 2,679,098 5/1954 Deicken ..... 30/DIG. 3
3,153,853 10/1964 Lipton ..... 30/DIG. 3
3,924,328 12/1975 Mould ..... 30/365 X

FOREIGN PATENT DOCUMENTS 1396874 3/1965 France ..... 30/DIG. 3
154429 12/1920 United Kingdom ..... 30/319

*Primary Examiner*—James G. Smith
*Attorney, Agent, or Firm*—Hume, Clement, Brinks, Willian & Olds, Ltd.

[57] ABSTRACT

A device for opening sealed bags containing foods of various types. A lever is pivoted to one end of a base plate and carries a serrated cutter wheel which is mounted for free rotation. The base plate has a recess which receives the cutting edge of the cutter wheel when the lever is pressed toward the base plate to a cutting position. The bag is inserted between the lever and base plate and is pulled through the device such that the peripheral teeth of the cutter wheel cut or perforate the bag.

6 Claims, 3 Drawing Figures

DEVICE FOR OPENING SEALED FOOD BAGS

BACKGROUND AND SUMMARY OF THE INVENTION

This invention relates to a kitchen appliance which is used to open sealed bags containing foods.

A large number of food products are packaged in various types of sealed bags. Examples of such bags are the relatively thick plastic bags known as retort pouches in which meats and frozen vegetables are packaged, the relatively thin plastic bags which contain other types of foods, and the various metal and plastic lined bags which contain foods such as nuts. In order to assure an effective seal of the contents and also to protect the food against pests and theft, the bags are often intentionally constructed in a manner to prevent them from being easily opened. Consequently, many types of bags are difficult if not impossible to open by hand, and knives, scissors, or other instruments must be used to open them. Even when such instruments are readily available, cutting of the bag at the desired location and in the proper manner is not always achieved. As a result, it is not uncommon for the contents of such bags to be spilled during attempts to open them.

The present invention provides a device which is specially constructed to quickly and easily open various types of sealed food bags. In a preferred form of the invention, a base plate is pivotally joined to a lever which carries a serrated cutter wheel at the end opposite the pivot connection. With a bag inserted between the lever and base plate, the lever may be pressed toward the base plate to force the cutter wheel against the bag. When the bag is pulled through the device, the cutter wheel shears the bag open or in some cases perforates it such that it can easily be torn open by hand.

It is an important object of the invention to provide a bag opening device which is capable of cutting open a wide variety of food bags constructed of various types of materials having various thicknesses. The cutter wheel is able to shear or perforate all types of bags in which foods are ordinarily packaged, from thin, pliable plastic bags to relatively thick plastic pouches and metallic bags.

Another object of the invention is to provide a bag opening device of the character described which is constructed in a simple and economical manner and which is compact for convenient storage.

A further object of the invention is to provide a bag opening device of the character described which is safe and reliable in operation. The cutter wheel is recessed in a cavity of the lever where it cannot be inadvertently contacted by the fingers, and the safety of the device is thus enhanced.

An additional object of the invention is to provide a bag opening device of the character described which is adapted to be held in the hand or to rest on a table or counter top during use.

Yet another object of the invention is to provide a bag opening device of the character described which accepts only those bags which the cutter wheel is capable of opening. The device rejects containers and other articles which are too large or thick to be opened properly by the cutter wheel, thereby avoiding possible damage to the cutting mechanism.

Other and further object of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 2:
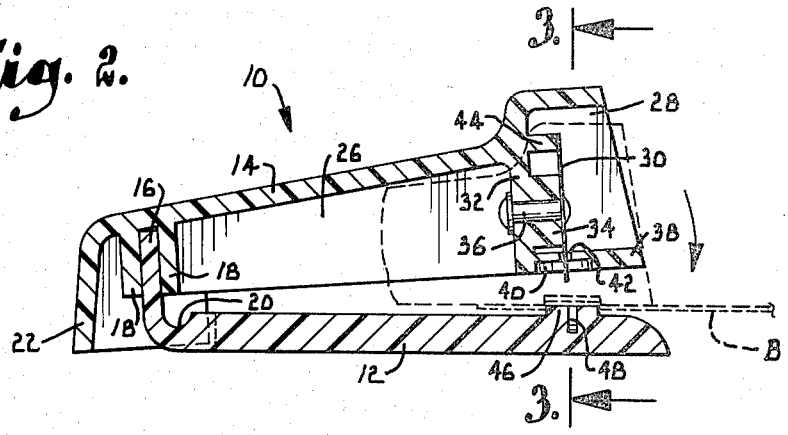
FIG. 2 is a sectional view taken generally along line 2—2 of FIG. 1 in the direction of the arrows.

Referring now to the drawing in detail, reference numeral 10 generally designates a bag opening device constructed in accordance with a preferred embodiment of the present invention. The bag opening device 10 is in the general shape of a "U", having one arm in the form of a base plate 12 and another arm in the form of a lever 14 which is pivotally joined at one end to base plate 12. The base plate 12 has a flat bottom surface which is adapted to rest on a table or counter top in order to support the unit thereon. One end of plate 12 has an upwardly extending flange 16 which is received between a pair of downwardly extending flanges 18 formed on lever 14 near one end thereof. A curved groove 20 is formed in the upper surface of plate 12 at a location adjacent the lower end of flange 16 in order to enhance the flexibility of the flange. Flange 16 is thus able to flex sufficiently to permit pivotal movement of lever 14 relative to plate 12 between the positions shown in broken lines and solid lines in FIG. 2. Lever 14 may be separated from base plate 12 simply by pulling it away from the base to detach flanges 18 from the flange 16 of the base plate.

Figure 1:
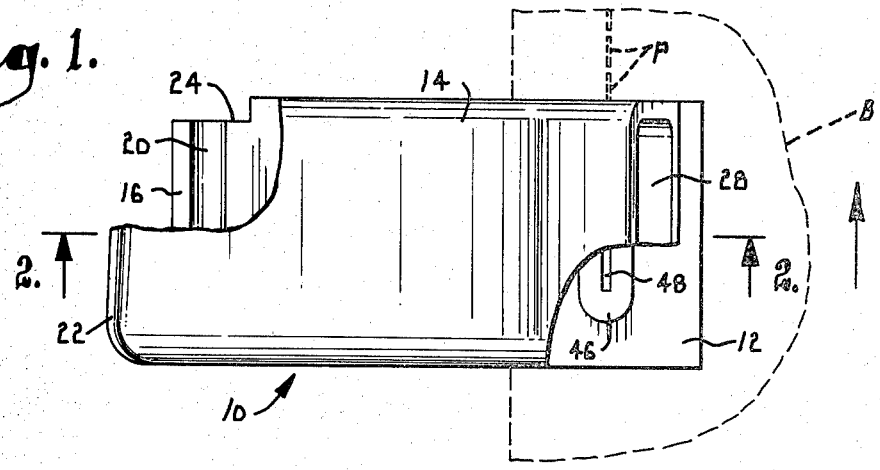
FIG. 1 is a top plan view of a bag opening device constructed according to a preferred embodiment of the present invention, with portions broken away for purposes of illustration.

An integral skirt 22 projects downwardly from the end of lever 14 and for a short distance along its sides. The side portions of base plate 12 adjacent flange 16 are recessed at 24 (FIG. 1) in order to receive the side portions of skirt 22. Lever 14 includes opposite side walls 26 having lower edges which are located above the body of base plate 12.

Figure 3:
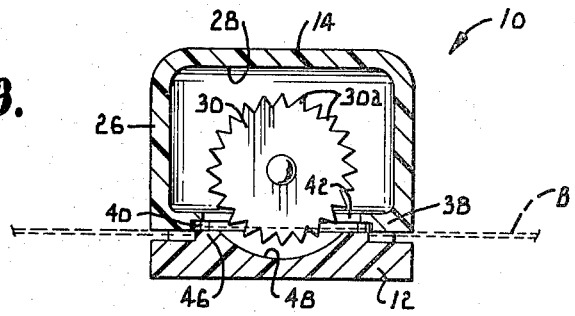
FIG. 3 is a sectional view taken generally along line 3—3 of FIG. 2 in the direction of the arrows.

The end of lever 14 opposite its pivot connection with base plate 12 is provided with a cavity 28 forming a housing in which a serrated cutter wheel 30 is mounted. Cavity 28 is open at the front and terminates at the rear in a solid wall 32 which is integral with lever 14. Wall 32 extends between the opposite side walls 26 of the lever. Cutter wheel 30 is mounted adjacent the outer surface of a boss 34 which is integral with wall 32 and which projects into cavity 28. Cutter wheel 30 is carried on one end of a generally horizontal pin 36 which extends through wall 32 and boss 34 and is supported for axial rotation. Wheel 30 is thus supported for free rotation within the housing defined by cavity 28 and is located in a plane oriented generally perpendicular to base plate 12. As best shown in FIG. 3 cutter wheel 30 has a peripheral cutting edge which includes a plurality of spaced apart teeth 30*a*.

A flat panel 38 is integral with the lower portion of wall 32 and sides 26 at the bottom of cavity 28. The underside of panel 38 has a recess 40 formed therein, and a thin slot 42 is formed through panel 38 at a location to intersect with recess 40. Cutter wheel 30 extends through slot 42, and its lower edge projects out of recess 40 below the bottom surface of panel 38. A small boss 44 (FIG. 2) projects into cavity 28 from lever 14 and engages the upper edge portion of cutter wheel 30 in a manner to maintain the alignment of the cutter wheel. The cutter wheel is thus prevented from wobbling, and its lower edge extends through the center of slot 42 without contacting the sides of the slot.

The upper surface of base plate 12 is provided with a boss 46 having a shape and size similar to the recess 40. A curved recess or groove 48 is formed in boss 46 at a location to receive the lower edge portion of cutter wheel 30 when lever 14 is pivoted downwardly to the cutting position shown in FIG. 3 and in broken lines in FIG. 2. In the cutting position, boss 46 is received in recess 40, and cutter wheel 30 enters groove 48.

The bag opening device 10 may be used to open a sealed bag B containing food. With lever 14 spread apart from base plate 12 as shown in solid lines in FIG. 2, the leading edge of bag B is inserted on top of boss 46. Lever 14 is then pressed downwardly toward plate 12 to force the teeth 30*a* of cutter wheel 30 through the bag into groove 48. Bag B is then pulled through the device in the direction indicated by the directional arrows in FIGS. 1 and 3. This causes cutter wheel 30 to rotate such that its teeth 30*a* cut through the bag as it passes through the device. The teeth either completely shear off the end of the bag or form a series of perforations P through the bag, depending upon the type of bag and its construction and thickness. When the bag has been complete pulled through the device, it is either sheared open along a straight line or provided with a series of perforations P which extend in a straight line. The bag may be subsequently torn open along the line defined by the perforations. When lever 14 is released, flange 16 flexes to return the lever to the spread apart position shown in solid lines in FIG. 2.

The bag may be inserted into the device as far as desired toward the pivoted end defined by flanges 16 and 18. Accordingly, virtually any portion of the bag may be cut open or perforated. When lever 14 is in the position shown in solid lines in FIG. 2, the distance between the lower edge of cutter wheel 30 and the upper surface of boss 46 is such that only relatively thin bags can be inserted into the device. Therefore, thick containers which could damage cutter wheel 30 are rejected by the device, and the fingers cannot be moved against the lower cutting edge of the cutter wheel. In addition, wheel 30 is housed within cavity 28 where it cannot be inadvertently contacted by the fingers.

It should be noted that the device can be held in the hand during use, with the fingers positioned against lever 14 and the thumb positioned against the underside of base plate 12. More frequently, the device will be used with plate 12 resting on a table or counter top.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, we claim:

1. A device for opening a sealed food bag containing food, said device comprising:

first and second arm members each having opposite first and second ends;

means for coupling said first ends of the arm members in a manner permitting the arm members to pivot toward and away from one another, said arm members being spaced apart at said second ends thereof to provide a space of sufficient size to receive the food bag;

a cutter wheel on said second end of the first arm member mounted for free rotation thereon about an axis of rotation, said cutter wheel having a peripheral cutting edge adapted to cut through the bag and projecting into said space;

a recess in said second end of the second arm located to receive said cutting edge of the wheel therein when said second ends of the arms are moved together to a bag cutting position, said cutting edge extending into said recess and penetrating a food bag inserted into said space when the arms are moved to the cutting position, whereby subsequent movement of the food bag relative to said cutter wheel effects cutting of the bag to open same; and a boss on said second end of said second arm member, said boss having a surface spaced away from said cutting edge when the arm members are spread apart, said recess being formed in said surface of the boss.

2. A device as set forth in claim 1, including an alignment member on said second end of the first arm member engaging a face portion of said cutter wheel at a location offset from said axis of rotation to prevent the cutter wheel from wobbling about said axis.

3. A device as set forth in claim 1, wherein said recess has an arcuate shape.

4. A device for opening a sealed food bag containing food, said device comprising:

first and second arm members each having opposite first and second ends;

means for coupling said first ends of the arm members in a manner permitting the arm members to pivot toward and away from one another, said arm members being spaced apart at said second ends thereof to provide a space of sufficient size to receive the food bag, said coupling means comprising:

a flange projecting from said first end of one of said arm members; and an opening formed in said first end of the other arm member, said flange fitting closely in said opening to provide said coupling means, said flange being flexible to permit pivotal movement of said arm members and being removable from said opening to permit detachment of said arm members from one another;

a cutter wheel on said second end of the first arm member mounted for free rotation thereon about an axis of rotation, said cutter wheel having a peripheral cutting edge adapted to cut through the bag and projecting into said space; and a recess in said second end of the second arm located to receive said cutting edge of the wheel therein when said second ends of the arms are moved together to a bag cutting position, said cutting edge extending into said recess and penetrating a food bag inserted into said space when the arms are moved to the cutting position, whereby subsequent movement of the food bag relative to said cutter wheel effects cutting of the bag to open same.

5. A device as set forth in claim 4, including an alignment member on said second end of the first arm member engaging a face portion of said cutter wheel at a location offset from said axis of rotation to prevent the cutter wheel from wobbling about said axis.

6. A device as set forth in claim 4, wherein said recess has an arcuate shape.

* * * * *